US005551133A

United States Patent [19]

Ferraro

[11] Patent Number: 5,551,133

[45] Date of Patent: Sep. 3, 1996

[54] DEVICE TO CORRECT THE LONGITUDINAL TORSION IN A TUBULAR FABRIC

[75] Inventor: Gian F. Ferraro, Varese, Italy

[73] Assignee: Albrecht Equipamentos Industrials Ltda.,, Santa Catarina, Brazil

[21] Appl. No.: 437,647

[22] Filed: May 9, 1995

[30] Foreign Application Priority Data

May 9, 1994 [IT] Italy ..... MI94A0905

[51] Int. Cl.[6] ..... D06C 3/00

[52] U.S. Cl. ..... 26/80; 26/87; 26/74

[58] Field of Search ..... 26/80, 87, 74, 26/83, 84, 72, 51, 51.3, 71; 57/1 UN; 68/13 R

[56] References Cited

U.S. PATENT DOCUMENTS

| | | | |
|---|---|---|---|
| 2,503,705 | 4/1950 | Blumenbaum et al. | 26/83 |
| 2,781,589 | 2/1957 | Cornwell | 26/83 |
| 3,235,906 | 2/1966 | Conti | 26/72 |
| 3,337,107 | 8/1967 | Catallo et al. | 26/80 |
| 3,436,935 | 4/1969 | Quoos et al. | 26/87 |
| 3,508,286 | 4/1970 | Rosen | 26/80 |
| 3,708,831 | 1/1973 | Burger | 26/87 |
| 4,843,669 | 7/1989 | Kochet et al. | 26/80 |
| 5,271,131 | 12/1993 | Jacumin | 26/80 |

FOREIGN PATENT DOCUMENTS

| | | | |
|---|---|---|---|
| 2926442 | 1/1981 | Germany | 26/80 |

*Primary Examiner*—Amy B. Vanatta
*Attorney, Agent, or Firm*—Kuhn and Muller

[57] ABSTRACT

A device to correct the longitudinal torsion in a tubular fabric includes a plurality of conveyor belts placed on two opposite sides of a balloon shaped by air pressure in a vertical segment of a fabric tube, each one composed of several rotatable rules which press the balloon up with its movement to pull it in the direction of a plurality of squeezer rubber cylinders which are in a transversal sliding direction in friction contact with the fabric to eliminate the longitudinal torsion from it.

8 Claims, 4 Drawing Sheets

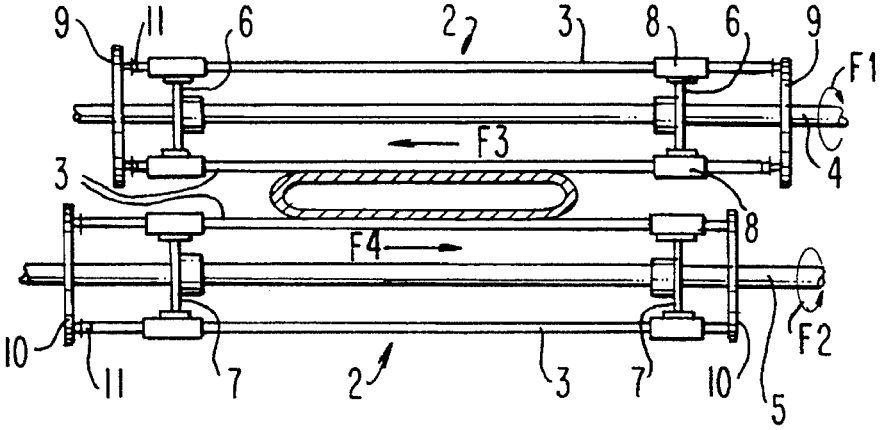
FIG. 1
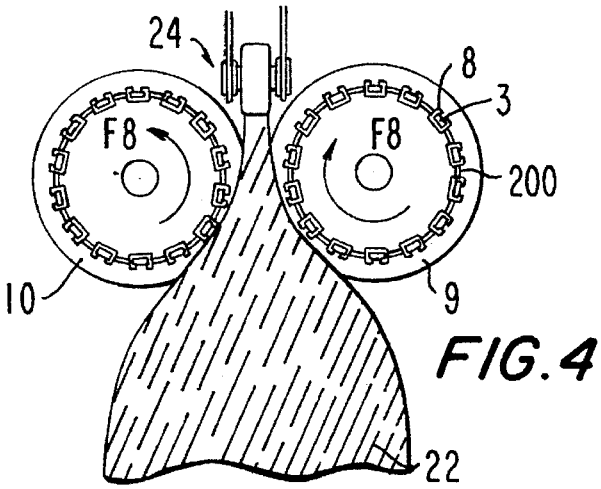
FIG. 4
FIG. 5
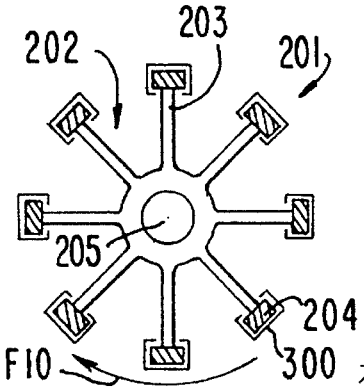
FIG. 6
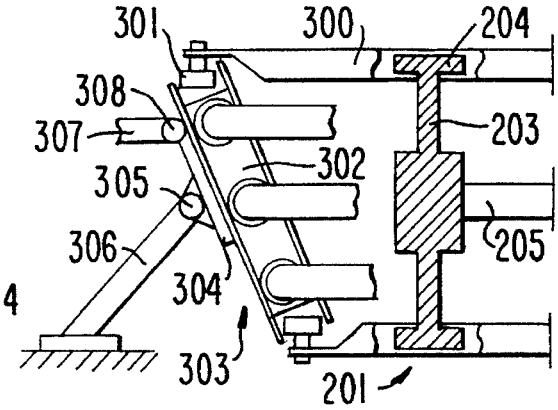

DEVICE TO CORRECT THE LONGITUDINAL TORSION IN A TUBULAR FABRIC

FIELD OF THE INVENTION

The present invention relates to a device to correct the longitudinal torsion in a tubular fabric in the textile industry, in particular to correct the longitudinal torsion in a tubular knit fabric, in which such torsion is present more often than in other types of fabric.

BACKGROUND OF THE INVENTION

In the textile Industry, a clothing product which has just come out of one or more textile machines and before the clothing product is used in the garment industry, undergoes several finishing operations. The finishing operations are more or less complex, which consist, for example, of dyeing, bleaching, mercerization of the clothing product and afterwards, drying and calendering. During the finishing operations the tubular fabrics adopt a longitudinal torsion, which remains on the manufactured pieces, bringing about the undesirable longitudinal torsion in the tubular portions of the clothing product, such as sleeves or pants legs. Such nuisances are easy to imagine and undesirable in a finished clothing product.

Applicant has no knowledge of the existence of a device or method to correct this undesirable longitudinal torsion in the clothing production process. However, it is known that before drying a fabric to send it to the calendering procedure, it is desirable to remove most of the part of the liquid within the clothing product. This operation of removing the liquid is nowadays done through one of the following methods: one first method one is through centrifuging the fabric which has been put in a "rope" arrangement in the centrifuges tanks. A second method which is better, is done through the use of hydro-extractor cylinders, that is, by using opposite cylinders of compression or absorption, which act upon the extremity of the "rope", including the treated clothing product which has been expanded through proper expanders.

In relation to the present invention it is important to remember that with this second method, to expand the fabric tube properly, it is sometimes used a procedure to blow air into the tube of the clothing product and in an appropriate position of the tube, so that it shapes itself in a "balloon" like shape, wherein one of its ends flattened and expanded in the desired measure, and it is introduced between the squeezer rubber cylinders.

OBJECTS OF THE INVENTION

It is therefore an object of the present invention to provide a method of device for eliminating undesirable torsion in a treated fabric having a tubular configuration.

It is also an object of the present invention to improve over the disadvantages of the prior art.

SUMMARY OF THE INVENTION

The device to which the present invention refers to, acts upon the aforementioned "balloon". The tubular fabric of the clothing product also maintains the longitudinal torsion in the balloon. The device of the present invention according to what is defined on the claims, herein, consists essentially of the procedural step of, leaning on each one of the opposite sides of the balloon, while using a revolving conveyor element, with a wall, which starts getting in friction contact with the fabric at points of the wall provided with a movement resulting from the application of a longitudinal part of the wall in the direction of the transfer of the tubular fabric to the adjoining device in its processing cycle, and at a transversal part in the opposite direction to the fabric torsion. As a result thereof, both conveyor elements, each element working with the combination of the mentioned longitudinal and transversal movements of its walls, competes to pull the fabric to the desired direction, for example, the fabric is pulled to the squeezer rubber cylinders, to correct the longitudinal torsion of the fabric, inclusive, until the longitudinal torsion is eliminated completely from the fabric. Preferably such conveyor elements are positioned adjacent to the end of the expandable balloon, which is linked to such adjoining device.

The aforesaid conveyor element may be, for example, a conveyor belt which makes a continuous rug turn around two parallel rotational axes, which axes are kept suitably bent in the opposite direction to the longitudinal torsion of the fabric and are made of a material which may create an appropriate friction on the fabric.

Alternatively the conveyor element constitutes a round or longish conveyor belt, or of a round winch, which maintains in its movement a certain quantity of rules, such as strip in frictional contact with the fabric, so that a part of the aforementioned conveyor element keeps in contact with the expandable balloon through the rules in a longitudinal movement, which is controlled in the direction of transference of the tubular fabric for such adjoining device, or at the same time, in the transversal movement controlled by the action of a transversal guide means positioned in an opposite direction to the fabric torsion. Therefore both conveyor elements, each one with the combination of the transversal and longitudinal movements of the rules, compete to pull the fabric to the desired direction, for example, for the squeezer rubber cylinders, and to correct the longitudinal torsion of the fabric until it is completely eliminated.

Preferably the longitudinal axis of both conveyor elements, of the type of longitudinally extending conveyor belts, are bent one on the other's direction, and in the direction of the opening between the squeezer rubber cylinders, so as to gradually and conveniently, approach and pull the expandable balloon walls, expand the tube and make it enter within and between the squeezer rubber cylinders.

The advantages of the device of the present invention are generally speaking, in allowing the correction of the torsion of a tubular fabric and, specifically, in being adjustable to act upon fabrics which have angles and directions of different torsion.

DESCRIPTION OF THE INVENTION

To allow a better understanding of the present invention, it is described in details in the attached drawings, in which:

FIG. 1 is a top plan layout view from the top of the device of the present invention;

FIG. 4 is a closeup partial side elevational view thereof;

FIG. 5 is another partial closeup side view of an alternate embodiment thereof;

FIG. 6 is another partial close-up front view thereof;

DETAILED DESCRIPTION OF THE DRAWINGS

Figure 2:
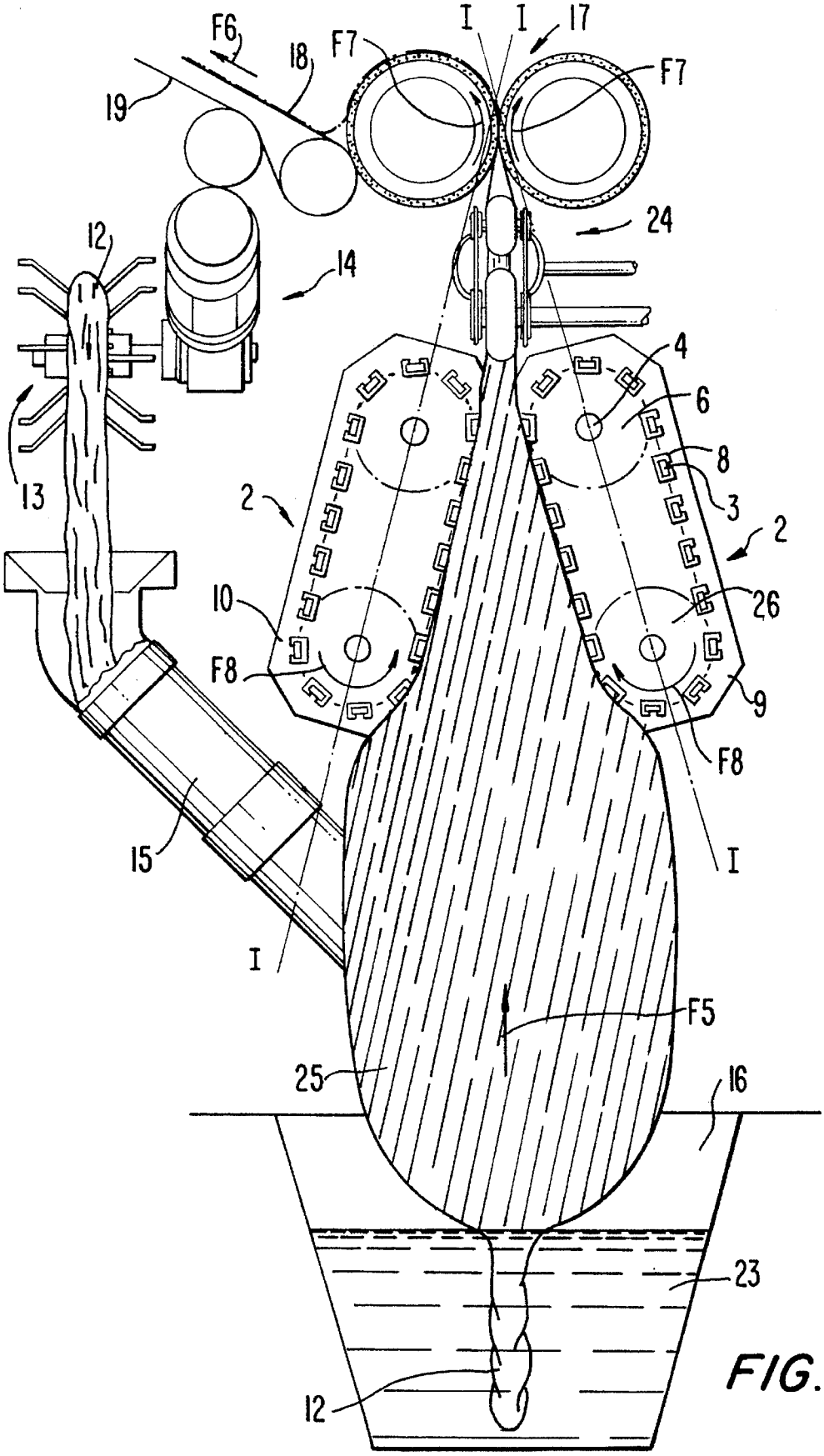
FIG. 2 is a partial side elevational view thereof.

FIG. 1 is a top plan layout view of the device of the present invention to correct longitudinal torsion in tubular fabrics, which helps to understand the principle of operation of the device. Fabric tube (1) has a torsion of which the direction is represented conventionally through the line drawn on the thickness of the tube wall, as also shown in FIG. 2, wherein tube (1) had been expanded previously in a "balloon" shape and now tube (1) is shown in its upper part already partially longitudinally extended and limited by a pair of conveyor belts (2) which press tube (1) upon two opposite sides. Through each conveyor belt (2) a series of rules (3), such as strips, is moved horizontally and in a parallel direction among itself, of which rules (3) the faces are in contact with fabric tube (1), and which faces of rules (3) are covered with a material which causes friction and contact with the fabric and which faces of rules (3) meet tube (1) before a lower part of conveyor belt (2), in order to afterwards go up to the direction of an upper part of conveyor belt (2) while said rules are always in contact with tube (1).

As shown in FIG. 1, arrows F1 and F2 indicate the direction of the rotation of drive shafts (4) and (5), which drive shafts (4) and (5) make pairs of traction wheels (6) and (7) turn. However, each rule (3) of each conveyor belt (2) slides horizontally between two kits (8) bound together to conveyor belt (2) in a horizontal movement in the indicated direction by arrows F3 and F4, under the action of pairs of side guides (9) and (10). This movement of rules (3) serves to make each rule (3) slide with friction on the wall of tube (1) in the opposite direction to the torsion of tube (1) itself, so that the sum of the action of rules (3) over tube (1) corrects or eliminates such longitudinal torsion.

To facilitate the slide of the rules (3) over side guides (9) and (10), the ends of each rule (3) of rules (3) is equipped with a movable cylinder (11) which turns over each of guides (9) and (10).

FIG. 2 shows a rope (12) made of tubular knit fabric (1) coming from a dyeing vat. Rope (12) advances by means of wheels (13) driven by electric motor (14) being conducted through a tubular passage (15) to a basin (16) from which basin (16) rope (12) is lifted in a direction indicated by arrow F5, to be passed between two squeezer rubber cylinders (17) that turn in a direction indicated by arrows F7, to deliver the fabric in an expanded band (18) to a conveyor belt (19) which leads bend in a direction indicated by arrow F6 to a conventional dryer (not shown).

Figure 3:
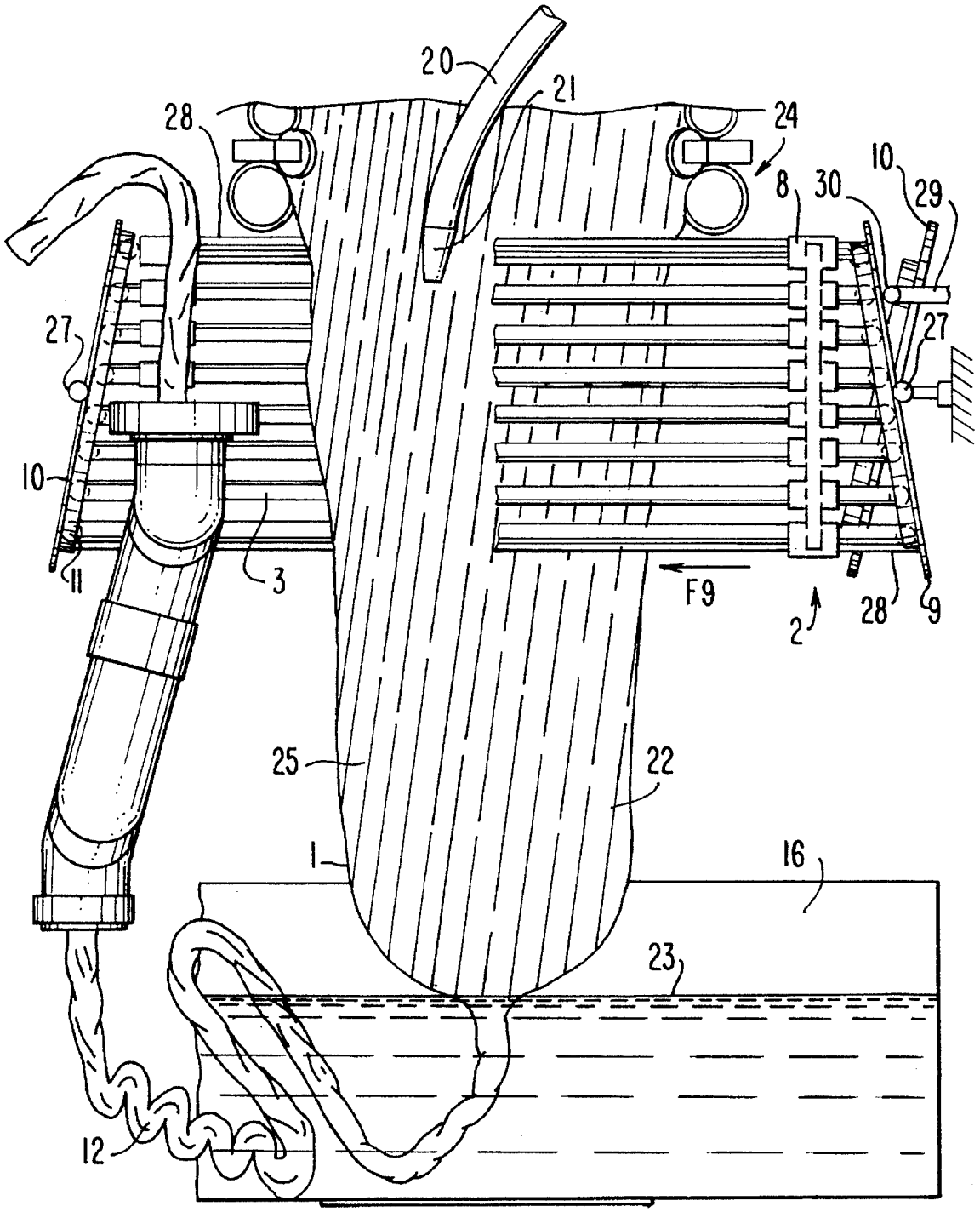
FIG. 3 is a partial front elevational view of a further alternate embodiment thereof.

As shown in FIG. 3, a compressed air channel (20) with tip 21 adjacent to the fabric tube (1) is suitable to make air therefrom penetrate on the fabric tube (1) through its stitches, so as to create and expand balloon (22), which balloon (22) has the lower end at the water level (23) in the basin (16) and in upper end adjacent to ring opener (24), which ring opener (24) is appropriate to give tube (1) the desired width compatible with its perimeter and elasticity, as shown in FIG. 3.

As shown in FIG. 2, sensibly lengthwise extending lines (25), but actually notably bent to the right in a direction perpendicular to the top of tube (1), indicate the torque lines exerted upon fabric tube (1) by the force of torsion. Adjacent to the upper end of balloon (22), over its two opposite sides, there are provided two longitudinally extending converyor belts (2), wherein each belt (2) is kept between engine wheel (6) which engine wheel (6) is moved by drive shaft (4) and movable wheel (26). Both conveyor belts (2) have a lengthwise axis I—I, bent to the direction of only one point in the region of squeezer rolls (17). Each conveyor belt (2) pulls the set of rules (3) according to the direction indicated by arrows F8 wherein each rule (3) is kept on corresponding conveyor belt (2) in a way that each rule (3) may slide to the cross direction inside each of two kits (8), which kits (8) are bound together with each respective conveyor belt (2), under action of side guides (9) and (10), which may be bent in a suitable manner, to correct torque lines (25) exerted by the force of torsion which one may desire to correct in fabric tube (1).

FIG. 3 also shows the sides of each conveyor belt (2), with each pair of guides (9) and (10) bent in a suitable manner, of which the functional task is to produce the movable sliding of rules (3) inside respective kits (8) in a suitable direction to correct the torque lines (25) exerted on fabric tube (1) by the force of torsion exerted on fabric tube (1). More exactly, the function is to do it in a way so as rules (3) of the previous conveyor belt (2) shown on the right side of FIG. 3, on the part which is contact with balloon (22), slide from the right to the left in the direction indicated by arrow F9. Rules (3) go up, controlled by guide (9), as seen on the right side of FIG. 3. At the same time rules (3) of the same conveyor belt (2) on its part in contact with balloon (22), slide from the left to the right as rules (3) go down, controlled by the left guide (10).

An opposite vice-versa procedure occurs for rules (3) of the posterior conveyor belt (2). Guides (9) and guides (10) may rotate and turn around a pulley (27) located at a point on one half of the height of each guide (9)(10). Each pair of guides (9)(10) is bound together by a rod (28) so that a pair of conventional rods (29), wherein each rod (29) is pivoted about fulcrum (30) over a corresponding guide (9) and (10) of both conveyor belts (2), may be operated through an electric motor or a person.

Therefore both pairs of guides (9)(10) assume an inclination more suitable to the features of each worked fabric. For example, as shown in FIG. 2, each guide (9)(10) is inclined at an incline which is suitable to the speed in which the fabric tube goes up to rubber cylinders (17), to the specific friction between the rules (3) and the fabric, and to the nature of the torsion that one wishes to eliminate. It is understood that the inclination of each pair of guides (9) (10) is opposite to the other pair of guides (9),(10).

FIG. 4 shows a first alternative to the conveyor element for accomplishing the elimination of torsion in a fabric tube (1) wherein cylindrical conveyor belt (200) is set under ring opener (24). As for conveyor belt (2) illustrated on FIGS. 2 and 3, also cylindrical conveyor belt 200, which turns in a direction according to arrows F8, presents rules (3) sliding in kits (8) and side guides (9) and (10), to make rules (3) slide laterally over the fabric of balloon (22).

FIGS. 5 and 6 show a second alternative (201) for the conveyor element, consisting essentially of a wheel (202) with rays (203) put into rotation in a direction indicated by arrow F10, about an axis (205) by means of an electric motor (not shown). The external extremity of each ray (203) takes one half of a guide (204) for the sliding of a guide rule (300), which guide rule (300) is kept on the two ends through cylinders (301) that slide on guide (302) of an inclinable leading wheel (303), which takes over an external wall a support (304), which support (304) is pivoted at two pivot points (305), to a pair of fixed arms (306) while a pivotable rod (307), pivoted at further pivot point (308) to support (304), may be pushed or pulled to make leading wheel (303) turn around pivot points (305) and imprint the desired inclination.

Figure 7:
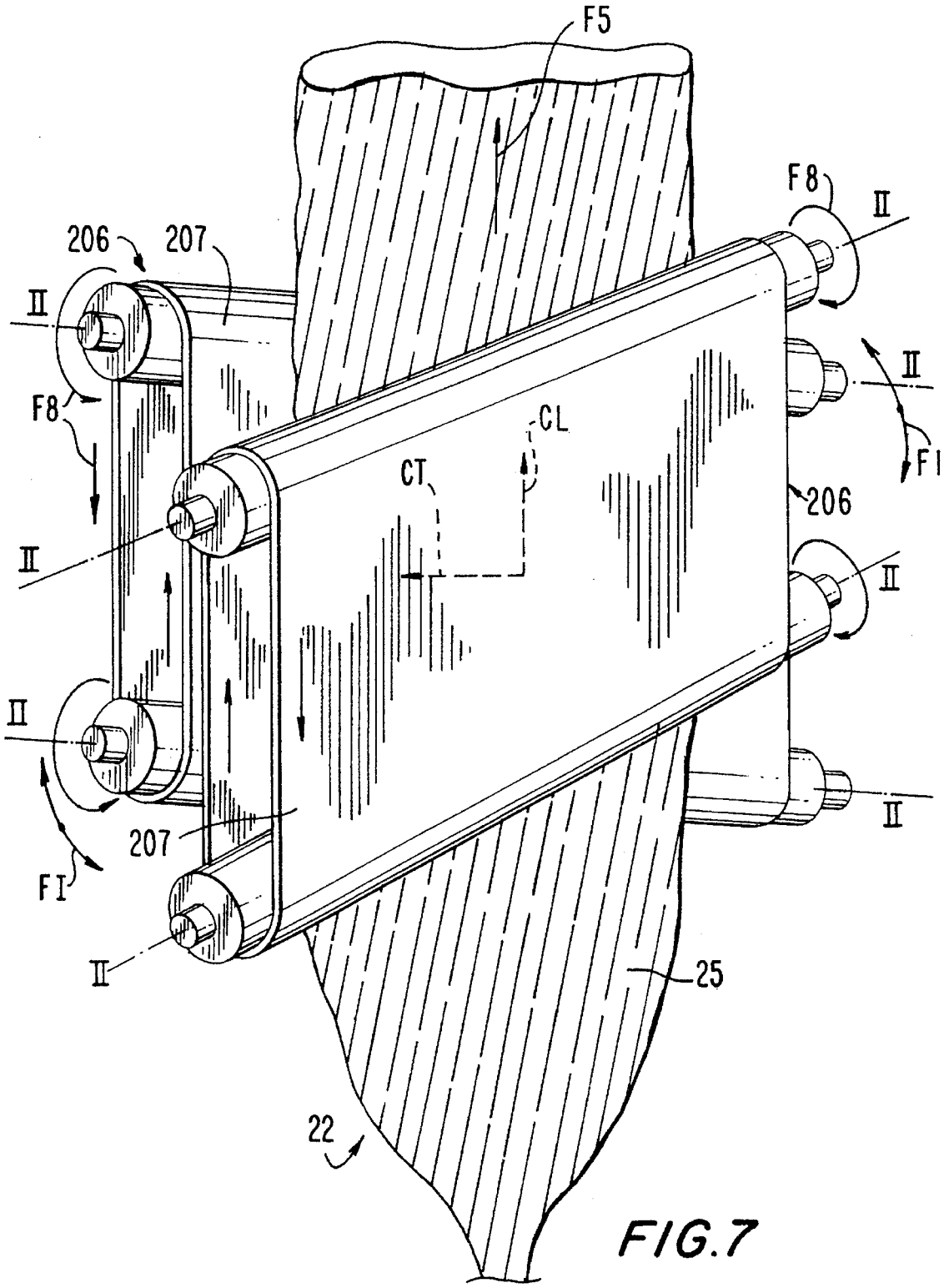
FIG. 7 is a partial perspective view thereof.

FIG. 7 shows a device that includes conveyor elements such as two conveyor belts (206), wherein each conveyor belt (206) rotates in a direction shown by arrows F8 to rotate a rug of rubber fabric (207). The rotation axis II—II is bent in the opposite direction to torques (25) exerted upon the fabric by torsion. CL and CT indicate the longitudinal component and the transversal component of the movement of each point at which the aforesaid rug (207) is in frictional contact with the fabric (22), CL and CT are on the upper part of the previous conveyor band. The arrows F1 indicate conventional devices by means of which the inclination of the rotational axis II—II of conveyor belts (206) may be varied according to necessity.

It is known that other indications may be made to the device of the present invention, in accordance with the scope of the invention, as noted in the appended claims.

I claim:

1. A device to correct the longitudinal torsion in a tubular fabric, wherein in a production phase the tubular fabric is formed with air pressure in a compressed air channel in the shape of a balloon, said device comprising:

a conveyor element supported on each of two opposite sides of the balloon, each said conveyor having a revolving wall belt, each said wall belt being in frictional contact with the tubular fabric at predetermined points on said revolving wall belt, said wall belt being pushed against the tubular fabric longitudinally and said wall belt being moved transversely in opposite directions to the longitudinal torque exerted by torsion upon the tubular fabric, both said conveyor elements being movable in combination wherein longitudinal movements of said wall belts push the fabric forward and transversal movements of said wall belts correct the torsion in the fabric, both the longitudinal movements and the transversal movements competing to pull the fabric tube in a longitudinal direction while correcting the longitudinal torsion of the tubular fabric.

2. The device to correct the longitudinal torsion in a tubular fabric according to claim 1, wherein said conveyor elements include said two wall belts, which said belts each rotate a rug inclined in an opposite direction to the torsion of the tubular fabric, to cause said rug to contact said tubular fabric longitudinally and transversally.

3. The device to correct the longitudinal torsion in a tubular fabric according to claim 1, wherein each said conveyor element is placed adjacent to an extremity of said balloon and said conveyor element contacts said tubular fabric below a rug opener and a pair of squeeze rollers between which said squeeze rollers said tubular fabric is squeezed and advanced.

4. A device to correct the longitudinal torsion in a tubular fabric wherein in a production phase the tubular fabric is formed with air pressure in a covered air channel in the shape of a balloon, said device comprising:

a conveyor element supported on each of two opposite sides of the balloon, each said conveyor having a revolving wall belt, each said wall belt being in a frictional contact with the tubular fabric at predetermined points on said revolving wall belt, said wall belt being pushed against the tubular fabric longitudinally and said wall belt being moved traversely in opposite directions to the longitudinal torque exerted by torsion upon the tubular fabric, both said conveyor elements being movable in combination wherein longitudinal movements of said wall belts push the fabric forward and transveral movements of said wall belts correct the torsion in the fabric, both the longitudinal and the transversal movements competing to pull the fabric tube in a longitudinal direction while correcting torsion wherein each said conveyor element includes a revolving wall being formed by a plurality of strips of rules, said rules each having surfaces in frictional contact with the tubular fabric, wherein further said conveyor element is moved over the tubular fabric in a longitudinal direction of the tubular fabric toward a ring opener and a pair of squeeze rollers, each said rule being in contact with the tubular fabric in transversal movements in opposite directions to the direction of the longitudinal torsion of the tubular fabric through the action of transversal guide means, each guide means moving in a direction transverse to the longitudinal direction of the tubular fabric, wherein both said conveyor elements, through the combination of the longitudinal and transversal movements of said rules, compete to pull the fabric in a transverse direction, to correct its longitudinal torsion.

5. The device to correct the longitudinal torsion in a tubular fabric, according to claim 4, wherein said transversal guide means comprises a plurality of hollow kits fixedly attached to said conveyor elements, wherein within each of said hollow kits each of said rules slide traversely under the action of said guides, said guides being equally attached and disposed on the sides of each end of said rules to determine the direction of the transversal slide of said rules in a direction transverse to the longitudinal movement of the tubular fabric.

6. The device to correct the longitudinal torsion in a tubular fabric according to claim 5, wherein the extremities of each one of said rules include movable cylinders that rotate over a corresponding guide.

7. The device to correct the longitudinal torsion in a tubular fabric according to claim 4, wherein each said guide means includes a pair of transversal guides and a pair of two opposite guides connected between each other, and controlled by a means of control wherein each pair of guides are inclined, equal and opposite to the one of the other pair, at predeterminated inclinations, in accordance to the grade of torsion to be corrected in each fabric.

8. The device to correct the longitudinal torsion in a tubular fabric according to claim 4, wherein said conveyor element includes two oblong conveyor belts each having a longitudinal axis equally inclined in a longitudinal direction to contact said balloon first at a swollen portion and thereafter flatten said balloon and advance said balloon in a flattened manner at an opening thereof.

* * * * *